United States Patent [19]

Siegrist

[11] 3,964,880

[45] June 22, 1976

[54] FUEL PASTE AND PROCESS FOR ITS PRODUCTION

[75] Inventor: Walter Siegrist, Visp (Kanton Wallis), Switzerland

[73] Assignee: Lonza Ltd., Gampel, Switzerland

[22] Filed: Oct. 17, 1974

[21] Appl. No.: 515,602

[30] Foreign Application Priority Data

July 16, 1974 Switzerland ..... 9763/74

[52] U.S. Cl. ..... 44/7 B; 44/7 D

[51] Int. Cl.[2] ..... C10L 7/00

[58] Field of Search ..... 44/7 R, 7 D, 7 B

[56] References Cited

UNITED STATES PATENTS 3,525,689 8/1970 Marotta ..... 44/7 D 3,880,569 4/1975 Bannister et al. ..... 44/7 D

*Primary Examiner*—Stephen J. Lechert, Jr.

*Attorney, Agent, or Firm*—Christen & Sabol

[57] ABSTRACT

A fuel paste which includes ethanol, an ethanol-soluble thickening agent and an inorganic fuel carrier mixture of silicon dioxide and (i) an oxide of silicon, other than silicon dioxide, (ii) an oxide of titanium, (iii) an oxide of zirconium, (iv) an oxide of aluminium, (v) a carbonate of an alkali metal, (vi) a carbonate of an alkaline earth metal, (vii) a hydroxide of an alkali metal, (viii) a hydroxide of an alkaline earth metal or (ix) a combination of two or more members of (i) to (viii). The fuel paste is non-thixotropic and is soft and plastic. The fuel paste has a number of other advantages. A process of preparing the fuel paste.

13 Claims, No Drawings

FUEL PASTE AND PROCESS FOR ITS PRODUCTION

BACKGROUND OF THE INVENTION

1. Field of This Invention

This invention relates to a fuel paste and a process for its production.

2. Prior Art

Fuel pastes have been made which contain an organic material as a foundation for the paste, but such fuel pastes burns with a strongly sooting flame. This is exceedingly unpleasant, particularly whenever, for example, a charcoal filling is burned on a grill.

Swiss Pat. No. 470,471 teaches a fuel paste that has as a fuel carrier substance purest silicon dixoide, the particle size of which varies from 3 to 40$\mu$. The fuel paste also contains ethanol, and is packaged in tubes to prevent any danger of explosions. The paste is made by adding the ethanol to the fuel carrier substance while stirring until a homogenous paste is obtained.

Swiss Patent-Of-Addition No. 482,008 discloses a non-thixotropic fuel paste which is soft and plastic that consists of 80 to 90 percent by weight of ethanol and 20 to 10 percent by weight of an inorganic fuel carrier mix. The inorganic fuel carrier mix contains, beside silicon dioxide, at least one other oxide compound of silicon, titanium, zirconium or aluminum or at least one carbonate or hydroxide of an alkali or alkaline earth metal. A process for its production is disclosed.

The known fuel pastes with inorganic material as a foundation leave a larger residue of non-combustible remainders (than do those with organic carriers) and the noncombustible inorganic portion of the pastes decreases their heating value.

BROAD DESCRIPTION OF THIS INVENTION

An object of this invention is to provide a fuel paste which is non-thixotropic, soft and plastic. Another object of this invention is to provide a fuel paste which has a higher heating value than an equal weight of known ethanol-containing fuel pastes. A further object of this invention is to provide a fuel paste which does not have any sooting of its flame when burning. Another object of this invention is to provide a fuel paste which forms less ash upon burning than known ethanol-containing fuel pastes. Another object of this invention is to provide a fuel paste which, upon burning, produces an ash which does not stick or has been resinified.

An object of this invention is to provide a process for preparing such a fuel paste.

Other objects and advantages of this invention are set forth elsewhere herein or are obvious to one ordinarily skilled in the art from the disclosure of this application.

Such objects and advantages are achieved or possessed, respectively, by this invention.

This invention involves a fuel paste. The fuel paste includes ethanol, an ethanol-soluble thickening agent and an inorganic fuel carrier mixture of silicon dioxide and (i) an oxide of silicon, other than silicon dioxide, (ii) an oxide of titanium, (iii) an oxide of zirconium, (iv) an oxide of aluminum, (v) a carbonate of an alkali metal, (vi) a carbonate of an alkaline earth metal, (vii) a hydroxide of an alkali metal, (viii) a hydroxide of an alkaline earth metal or (ix) a combination of two or more members of (i) to (viii). The fuel paste is non-thixotropic and is soft and plastic. Preferably the fuel paste contains 0.1 to 8 percent by weight of the inorganic fuel carrier mixture, 77 to 96.3 percent by weight of ethanol and 0.1 to 5 percent by weight of the alcohol-soluble thickening agent (the weights being based on the total weight of the fuel paste). Preferred inorganic fuel carrier mixtures are: silicon dioxide and calcium hydroxide; silicon dioxide, titanium dioxide and calcium hydroxide; and silicon dioxide and aluminum dioxide. Preferably the ethanol-soluble thickening agent is a cellulose ether, and most preferably is hydroxypropyl cellulose.

The fuel paste has a higher content of combustible material, as a result of which a comparatively higher heating value is achieved. The portion of noncombustible material is decreased and thus the forming of ashes is reduced. A sooting of the flame, despite a higher content of combustible material, is not observed during burning and a resinification or sticking of the ashes due to the use of the organic thickening agent does not occur. These advantages are over known ethanol-soluble fuel pastes.

This invention includes a process for preparing a fuel paste which includes (a) admixing alcohol with an inorganic fuel carrier mixture of silicon dioxide and (i) an oxide of silicon, other than silicon dioxide, (ii) an oxide of titanium, (ii) an oxide of zirconium, (iv) an oxide of aluminum, (v) a carbonate of an alkali metal, (vi) a carbonate of an alkaline earth metal, (vii) a hydroxide of an alkali metal, (viii) a hyroxide of an alkaline earth metal or (ix) a combination of two or more members of (i) to (viii), and (b) admixing an ethanol-soluble thickening agent to admixture (a). The resulting paste is non-thixotropic, soft and plastic.

This invention further includes a process for preparing a fuel paste which involves (a) admixing an ethanol-soluble thickening agent, a substantial portion of the final amount of ethanol and an inorganic fuel carrier mixture of silicon dioxide and (i) an oxide of silicon, other than silicon dioxide, (ii) an oxide of titanium, (iii) an oxide of zirconium, (iv) an oxide of aluminum, (v) a carbonate of an alkali metal, (vi) a carbonate of an alkaline earth metal, (vii) a hydroxide of an alkali metal (viii) a hydroxide of an alkaline earth metal or (ix) a combination of two or more members of (i) to (viii), (b) adding water to admixture (a), a thick dough resulting, (c) allowing admixture (b) to set to complete the swelling of said thick dough, and (d) admixing the rest of the ethanol with admixture (b). The resulting paste is non-thixotropic, soft and plastic.

This invention further includes a process for preparing a fuel paste which involves (a) admixing a substantial portion of the final amount of the ethanol with silicon dioxide and a member selected from the group consisting of (i) an oxide of silicon, other than silicon dioxide, (ii) an oxide of titanium, (iii) an oxide of zirconium, (iv) an oxide of aluminum, (v) a carbonate of an alkali metal, (vi) a carbonate of an alkaline earth metal, (vii) a hydroxide of an alkali metal, (viii) a hydroxide of an alkaline earth metal other than calcium hydroxide or (ix) a combination of two or more members of (i) to (viii), a liquid resulting, and (b) admixing calcium hydroxide, an ethanol-soluble thickening agent and the remainder of the ethanol with admixture (a). This causes jelling of the liquid. The resulting paste is non-thixotropic, soft and plastic. Preferably admixing step (a) is conducted using stirring.

DETAILED DESCRIPTION OF THIS INVENTION

Any ethanol-soluble thickening agent can be used. Examples of useful ethanol-soluble thickening agents are ethanol-soluble cellulose ethers, such as, ethyl hydroxy ethyl cellulose, hydroxypropyl cellulose, methylhydroxybutyl cellulose, methylhydroxyethyl cellulose and ethyl cellulose and ethanol-soluble material having high viscosities, such as, polyvinylpyrrolidone, copolymers of ethylvinyl ether and maleic anhydride and polyacrylic acid. The ethanol-soluble thickening agent is preferably a cellulose ether, and most preferably is hydroxypropylcellulose. Depending on its solubility, it may be necessary to pre-swell the ethanol-soluble thickening agents with strongly aqueous ethanol.

The fuel paste can contain up to 20 percent by weight of water.

Pure or raw ethanol can be used. For example, raw ethanols having, as low as 61 percent ethanol can be used.

As used herein, alkali metal includes lithium, sodium, potassium, Rb, Cs and Fr. As used herein, alkaline earth metal includes Be, magnesium, calcium, Sr, barium and Ra.

Examples of useful alkali metal hydroxides that can be used in the inorganic fuel carrier mixture are LiOH, KOH, NaOH CsOH. Examples of useful alkali metal carbonates which can be used in the inorganic mixture are $Li_2CO_3$, $K_2CO_3$, $Na_2CO_3$, $Rb_2CO_3$ and $Cs_2CO_3$. Examples of useful alkaline earth hydroxides that can be used in the inorganic fuel carrier mixture are $Sr(OH)_2$, $Ba(OH)_2$ and $Ca(OH)_2$. Examples of useful alkaline earth carbonates that can be used in the inorganic fuel carrier mixture are $SrCO_3$, $BaCO_3$, $BeCO_3$, $CaCO_3$ and $RaCO_3$.

Useful titanium oxides are TiO, $Ti_2O_3$ and $TiO_2$. A useful zirconium oxide is $ZrO_2$. A useful aluminum oxide is $Al_2O_3$. A useful silicon oxide is $Si_2O_3$.

As used herein all percentages, parts and proportions are on a weight basis, unless otherwise stated or obvious to one ordinarily skilled in the art.

EXAMPLE 1

The following ingredients were weighed and placed into a kneader:

2,874 gm of ethanol
72 gm of silicon dioxide, and
1.2 gm of calcium hydroxide

The mixture was kneaded. To this well homogenized mixture, there was added, while stirring rapidly for 1.5 minutes:

54 gm of hydroxypropyl cellulose, highly viscous. The mixture thickened gradually until it was a gel-like mass, which after 1.5 hours was completely homogenous.

EXAMPLE 2

Example 1 was repeated using the following ingredients:

2,898 gm of alcohol
6 gm of silicon dioxide
6 gm of titanium dioxide, highly dispersed
0.1 gm of calcium hydroxide
90 gm of hydroxypropyl cellulose

EXAMPLE 3

1,026 gm of ethanol (94 percent)
6 gm of aluminum oxide, highly dispersed 6 gm of silicon dioxide, and
84 gm of methylhydroxybutyl cellulose were mixed for 10 minutes at a medium speed in a strong kneader.

Then 374 gm of water were added, whereupon the mixture quickly swelled to a thick dough. After 20 minutes, the swelling was complete. Then slowly 1,504 gm of ethanol (94 percent)

was added, whereupon a soft homogeneous jelly (paste) was formed.

The fuel pastes of Examples 1 to 3 were non-thixotropic, soft and plastic, left less ash upon burning than known ethanol-containing fuel pastes, had no soot in the flame when burned, had a higher heating value than known ethanol containing fuel pastes, and had no resinification or sticking of the ash after burning.

The pastes resulting from Examples 2 and 3 have different burning characteristics, but they could be mixed with one another depending upon the desired characteristics of the end product.

What I claim is:

1. A fuel paste which comprises (a) ethanol, (b) an ethanol-soluble thickening agent and (c) an inorganic fuel carrier mixture of silicon dioxide and at least one member selected from the group consisting of (i) an oxide of silicon, other than silicon dioxide, (ii) an oxide of titanium, (iii) an oxide of zirconium, (iv) an oxide of aluminum, (v) a carbonate of an alkali metal, (vi) a carbonate of an alkaline earth metal, (vii) a hydroxide of an alkali metal and (viii) a hydroxide of an alkaline earth metal, said fuel paste being non-thixotropic and being soft and plastic.

2. A fuel paste as described in claim 1 wherein said inorganic fuel carrier mixture (c) includes silicon dioxide and a combination of at least two members of (i) to (viii).

3. A fuel paste as described in claim 1 wherein said fuel paste contains 0.1 to 8 percent by weight of said inorganic fuel carrier mixture, 77 to 96.3 percent by weight of said ethanol and 0.1 to 5 percent by weight of said alcohol-soluble thickening agent said weights being based on the total weight of said fuel paste.

4. A fuel paste as described in claim 1 wherein said inorganic fuel carrier mixture contains silicon dioxide and calcium hydroxide.

5. A fuel paste as described in claim 1 wherein said inorganic fuel carrier mixture contains silicon dioxide, titanium dioxide and calcium hydroxide.

6. A fuel paste as described in claim 1 wherein said inorganic fuel carrier mixture contains silicon dioxide and aluminum dioxide.

7. A fuel paste as described in claim 1 wherein said ethanol-soluble thickening agent is a cellulose ether.

8. A fuel paste as described in claim 1 wherein said ethanol-soluble thickening agent is hydroxypropyl cellulose.

9. A fuel paste as described in claim 1 wherein said fuel paste contains water up to 20 percent by weight of water based on the total weight of said fuel paste.

10. A process for preparing a fuel paste which comprises (a) admixing alcohol with an inorganic fuel carrier mixture of silicon dioxide and at least one member selected from the group consisting of (i) an oxide of silicon, other than silicon dioxide, (ii) an oxide of titanium, (iii) an oxide of zirconium, (iv) an oxide of aluminum, (v) a carbonate of an alkali metal, (vi) a carbonate of an alkaline earth metal, (vii) a hydroxide of an alkali metal and (viii) a hydroxide of an alkaline earth metal, and (b) admixing an ethanol-soluble thickening agent to admixture (a), the resulting paste being non-thioxotropic, soft and plastic.

11. A process for preparing a fuel paste which comprises (a) admixing an ethanol-soluble thickening agent, a substantial portion of the final amount of ethanol and an inorganic fuel carrier mixture of silicon dioxide and at least one member selected from the group consisting of (i) an oxide of silicon, other than silicon dioxide, (ii) an oxide of titanium, (iii) an oxide of zirconium, (iv) an oxide of aluminum, (v) a carbonate of an alkali metal, (vi) a carbonate of an alkaline earth metal, (vii) a hydroxide of an alkali metal and, (viii) a hydroxide of an alkaline earth metal, (b) adding water to admixture (a), a thick dough resulting, (c) allowing admixture (b) to set up to complete the swelling of said thick dough, and (d) admixing the rest of the ethanol with admixture (b), the resulting paste being non-thixotropic, soft and plastic.

12. A process for preparing a fuel paste which comprises (a) admixing a substantial portion of the final amount of the ethanol with an inorganic fuel carrier mixture of silicon dioxide and at least one member selected from the group consisting of (i) an oxide of silicon, other than silicon dioxide, (ii) an oxide of titanium, (iii) an oxide of zirconium, (iv) an oxide of aluminum, (v) a carbonate of an alkali metal, (vi) an carbonate of an alkaline earth metal, (vii) a hydroxide of an alkali metal and (viii) a hydroxide of an alkaline earth metal, other than calcium hydroxide, a liquid resulting, and (b) admixing calcium hydroxide, an ethanol-soluble thickening agent and the remainder of the ethanol with admixture (a), the resulting paste being non-thixotropic, soft and plastic.

13. A process as described in claim 12 wherein the admixing step (a) is conducted with stirring.

* * * * *